United States Patent [19]

Holzapfel et al.

[11] Patent Number: 4,998,394

[45] Date of Patent: Mar. 12, 1991

[54] MASONRY WALL STRUCTURE AND METHOD OF MAKING THE SAME

[75] Inventors: Robert C. Holzapfel, Arlington Heights, Ill.; Michael P. Mottet, Bettendorf, Iowa; Thomas W. Riggle, Phoenix, Ariz.

[73] Assignee: Iowa State University Research Foundation, Inc., Ames, Iowa

[21] Appl. No.: 335,437

[22] Filed: Apr. 10, 1989

[51] Int. Cl.[5] ..... E04B 2/04; E04B 2/58; E04B 2/86

[52] U.S. Cl. ..... 52/426; 52/434; 52/442

[58] Field of Search ..... 52/426, 425, 442, 434, 52/568, 565, 562, 309.12, 379, 378, 424, 427, 428, 383, 743, 746, 747

[56] References Cited

U.S. PATENT DOCUMENTS

| | | | |
|---|---|---|---|
| 960,043 | 5/1910 | Selden | 52/428 |
| 3,377,764 | 4/1968 | Storch | 52/426 |
| 3,788,020 | 1/1979 | Gregori | 52/309 |
| 4,229,920 | 10/1980 | Lount | 52/309 |
| 4,263,765 | 4/1981 | Maloney | 52/562 |
| 4,373,314 | 2/1983 | Allan | 52/434 |
| 4,606,163 | 8/1986 | Catani | 52/434 |
| 4,622,796 | 11/1986 | Aziz et al. | 52/379 |
| 4,706,429 | 11/1987 | Young | 52/309 |
| 4,827,684 | 5/1989 | Allan | 52/428 |
| 4,843,776 | 7/1989 | Guignard | 52/434 |
| 4,852,320 | 8/1989 | Ballantyne | 52/562 |

FOREIGN PATENT DOCUMENTS 1558164 12/1979 United Kingdom ..... 52/562

*Primary Examiner*—Michael Safavi

*Attorney, Agent, or Firm*—Zarley, McKee, Thomte, Voorhees & Sease

[57] ABSTRACT

A veneer wall consisting of a plurality of masonry units held together by conventional vertical and horizontal mortar joints. A plurality of straight horizontal tie members with opposite ends and a center portion have one end thereof embedded in one of the mortar joints to cause the tie members to extend horizontally outwardly with respect to the veneer wall. Insulation panels having inner and outer sides extend in spaced parallel relation to the veneer wall with the panels being secured to the outer ends of the tie members. A solid poured-in-place concrete wall fills the space between the insulation panels and the veneer wall and embed the tie members. A rigid stud wall of conventional constructions is imposed on the outer side of the insulation panel. The method of the invention forms a veneer wall on a support means from a plurality of masonry units held together by conventional horizontal and vertical mortar joints; thence embedding one end each of a plurality of straight horizontal tie members into the mortar joints while the veneer wall is being formed, and before the mortar joints are set; hence placing a plurality of insulation panels in parallel spaced relation to the veneer wall to create a vertical space therebetween; thence securing the insulation panels to the outer ends of the wall ties; and then filling the space between said veneer wall and said insulation panels with plastic concrete and allowing the concrete to set.

4 Claims, 2 Drawing Sheets

MASONRY WALL STRUCTURE AND METHOD OF MAKING THE SAME

BACKGROUND OF THE INVENTION

Because of the development of the steel-framed building with a masonry skin in the past Century, load-bearing masonry has generally been considered expensive and unnecessary. It is often desired, even at the present time, to use load-bearing masonry as an exterior finish, but the cost is not justified.

The principal object of this invention is to provide a masonry wall structure and method of making the same that can easily and inexpensively integrate load-bearing masonry into today's construction methods.

A further object of this invention is to provide a masonry wall and method of making the same which provides a shorter construction period which directly translates into cheaper construction costs and added revenue to the owner.

A still further object of this invention is to provide a masonry wall structure and method of making the same that can be adapted to many existing building systems.

These and other objects of the invention will be seen by those skilled in the art.

SUMMARY OF THE INVENTION

The instant invention comprises a veneer wall consisting of a plurality of masonry units held together by conventional vertical and horizontal mortar joints. A plurality of straight horizontal tie members with opposite ends and a center portion have one end thereof embedded in one of the mortar joints to cause the tie members to extend horizontally outwardly with respect to the veneer wall. Insulation panels having inner and outer sides extend in spaced parallel relation to the veneer wall with the panels being secured to the outer ends of the tie members. A solid poured-in-place concrete wall fills the space between the insulation panels and the veneer wall and embed the tie members. A rigid stud wall of conventional constructions is imposed on the outer side of the insulation panel.

The method of the invention comprises forming the veneer wall on a support means from a plurality of masonry units held together by conventional horizontal and vertical mortar joints; thence embedding one end each of a plurality of straight horizontal tie members into the mortar joints while the veneer wall is being formed, and before the mortar joints are set; thence placing a plurality of insulation panels in parallel spaced relation to the veneer wall to create a vertical space therebetween; thence securing the insulation panels to the outer ends of the wall ties; and then filling the space between said veneer wall and said insulation panels with plastic concrete and allowing the concrete to set.

DESCRIPTION OF THE PREFERRED EMBODIMENT

A conventional brick veneer wall 10 is mounted on a horizontal concrete or masonry foundation (not shown). Wall 10 is comprised of a plurality of bricks or masonry units 12 which are conventionally held together by conventional horizontal mortar joints 14 and vertical mortar joints 16.

Figure 1:
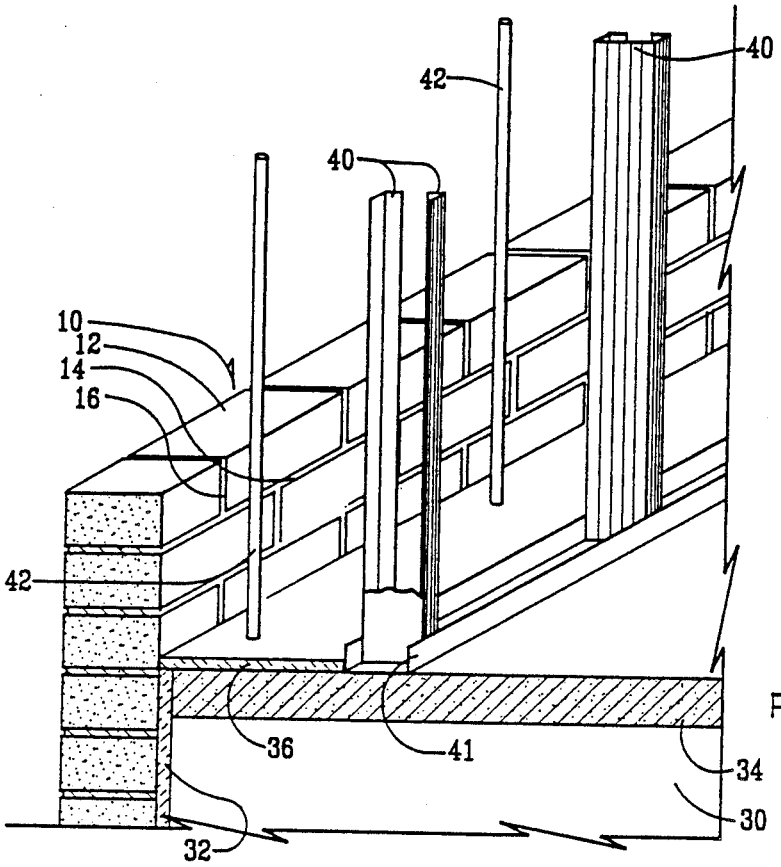
FIG. 1 is a partial sectional view of the wall system of this invention during a preliminary phase of construction.
Figure 2:
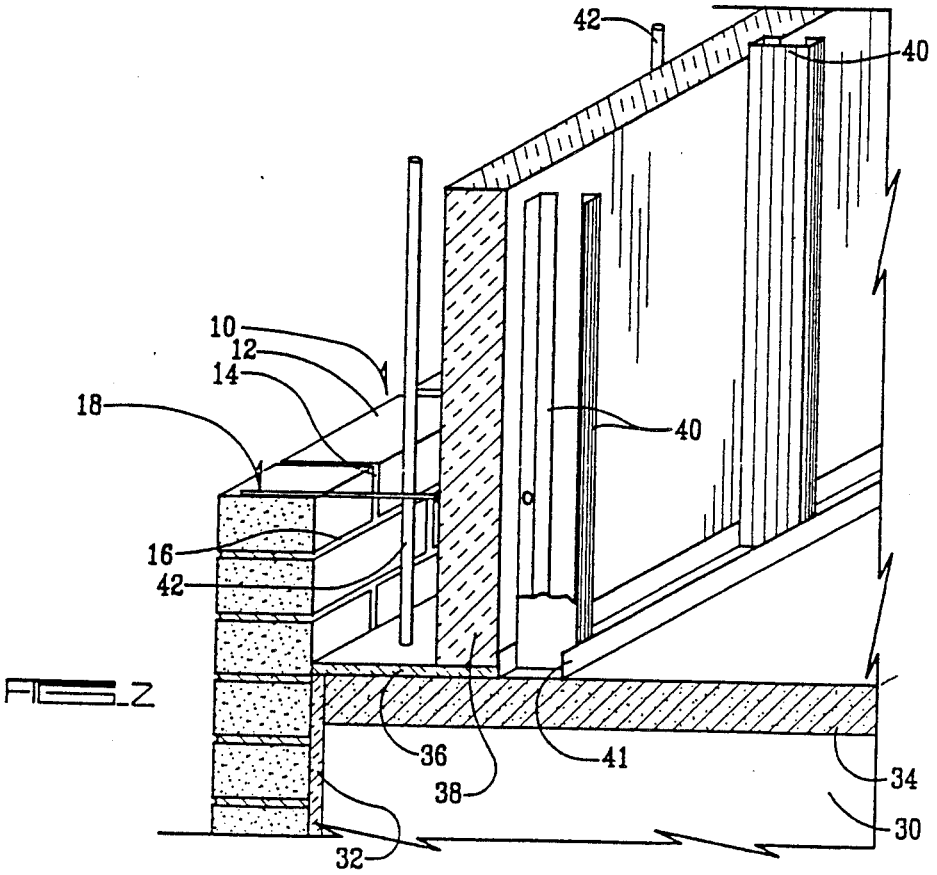
FIG. 2 is the next phase of construction with the insulation panels being placed in spaced relation to the veneer wall and with some of the horizontal wall ties in position.
Figure 3:
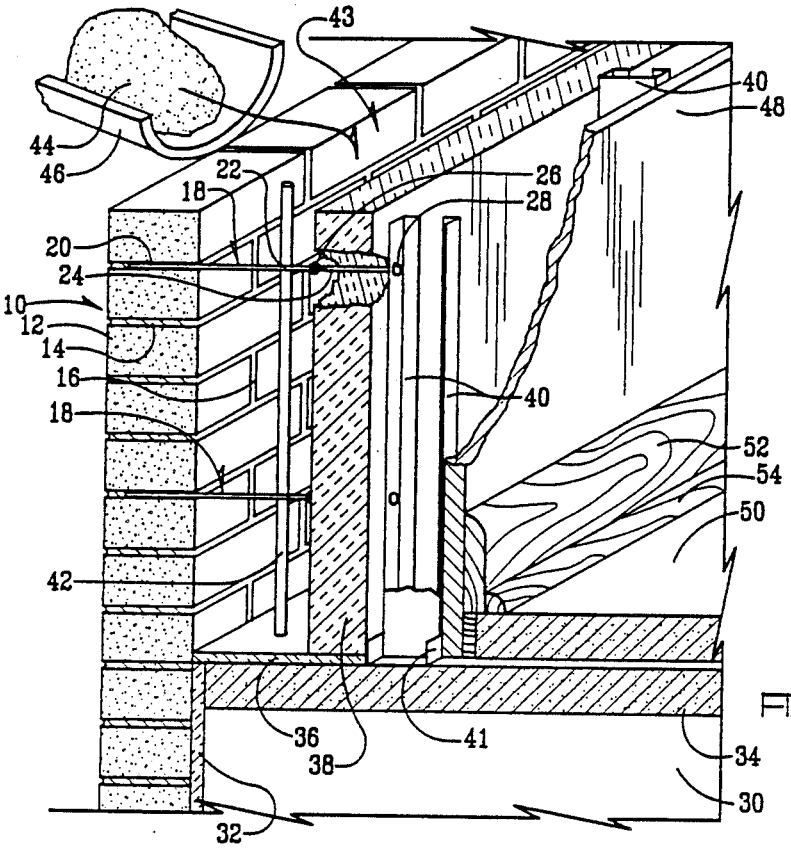
FIG. 3 shows a further step in the construction of the wall system of this invention with the plastic concrete about to be placed in the space between the veneer wall and the insulation panels.
Figure 4:
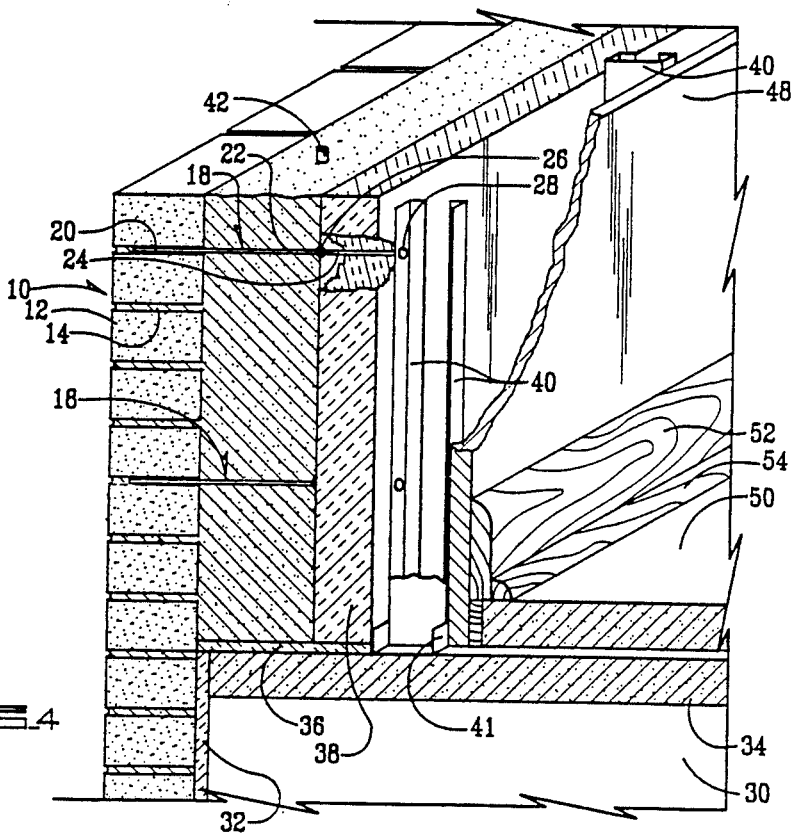
FIG. 4 is a view similar to that of FIG. 3, showing the hardened concrete wall in place between the veneer wall and the insulation panels.

Horizontal elongated fiberglass tie rods 18 having inner ends 20 and outer ends 22 have inner ends 22 imbedded in various of the horizontal mortar joints 14. The outer ends 22 protrude at right angles to the wall 10 as shown in FIGS. 2, 3, and 4. Tie rod extensions 24 are threadably or otherwise secured to the outer ends 22 of tie rods 18. A washer 26 is secured against horizontal movement at the point of connection between tie rod extensions 24 and the outer end 22 of tie rods 18. Heads 28 appear on the ends of tie rod extensions 24 opposite the outer ends 22 of tie rods 18 and serve to connect the tie rod extensions 24 to an interior wall, as will be discussed hereafter.

A foundation or fill material 30 is located inwardly of veneer wall 10 but is separated from the veneer wall by a vertical layer of insulation 32. A horizontal subfloor 34 of concrete or the like is mounted on foundation 30 and has a horizontal layer of insulation 36 extending at least adjacent the length of the veneer wall 10. A plurality of vertical insulation panels 38 are supported on the insulation layer 36 and are supported in part by the structural members of an interior wall comprised of conventional vertical metal studs 40 having conventional side flanges, and a horizontal stud member 41 which is secured by conventional means to the interior floor 50.

It should be noted that the tie rod extensions 24 extend through the vertical insulation panels and serve to maintain the insulation panels in their vertical position. As shown in FIGS. 2, 3, and 4, the head 28 of tie rod extensions impinges on the inner flange of vertical metal studs 40, and the vertical metal studs also provide support for the insulation panels 38. Vertical reinforcing rods 42 (and also horizontal rods, if desired) can be placed in vertical space 43. Plastic concrete 44 is then deposited within the vertical space 43, and the concrete wall 45 is thereupon formed between the veneer wall 10 and the insulation panels 38. Plastic concrete 44 is conventionally deposited into the vertical space 43 by means of conventional concrete chute 46.

A wall structure is thereby formed consisting of veneer wall 10, concrete wall 43, and insulation panels 38, all of which are tied together by tie rods 18 and tie rod extensions 24. In addition, the vertical metal studs 40 comprise an interior wall which provides support to the insulation panels 38 during the concrete pouring process. Wall board or the like 48 can be conventionally secured to the outer flanges of studs 40. A finished floor 50 can be superimposed on subfloor 34. Conventional baseboard 52 can be secured by conventional means to the intersection of finished floor 50 and wall board 48.

The foregoing invention provides a wall system which results in a shorter construction period and which can be adapted to many existing building systems. The interior wall structure comprised of horizontal stud member 41 and vertical metal studs 40 reinforce panels 48, all of which are tied to the rigid veneer wall 10 by a plurality of tie rods 18. This creates an effective concrete form for reception of the plastic concrete 44 which results in the concrete wall 45.

It is thus seen that an efficient and economical wall structure and method of building the same are realized by this invention.

We claim:

1. A wall structure comprising:

a veneer wall comprised of a plurality of masonry units held together by mortar joints a plurality of straight horizontal tie members having opposite first and second ends and a center portion, with said first ends of said tie members being embedded in one of said mortar joints to cause said tie members to extend horizontally outwardly with respect to said veneer wall, insulation panels having inner and outer sides and extending in spaced parallel relation to said veneer wall, with said panels being secured to the second ends of said tie members, a rigid stud wall comprising a plurality of spaced rigid elongated members positioned adjacent the outer side of said insulation panels, and solid poured-in-place concrete filling the space between said insulation panels and said veneer wall and embedding said tie members therein.

2. The wall structure of claim 1 wherein said tie members are comprised of fiberglass.

3. A method of making a wall structure for a building, comprising, forming a horizontally disposed base support means, forming a veneer wall on said support means from a plurality of masonry units held together by mortar joints, embedding one end each of a plurality of straight horizontal tie members into said mortar joints while said veneer wall is being formed and before said mortar joints have set, forming a rigid stud wall having inner and outer sides and being comprised of a plurality of spaced vertical studs parallel to but in spaced relation to said veneer wall, placing a plurality of relatively lightweight insulation panels having inner and outer sides adjacent the inner side of said stud wall to close the spaces between said studs in parallel spaced relation to said veneer wall to create a vertical space therebetween, securing said insulation panels to the outer ends of said wall ties, filling said space between said veneer wall and said insulation panels with concrete, and allowing said concrete to set.

4. The method of claim 3 wherein the outer end of said tie members extend through said insulation panels.

* * * * *